United States Patent [19]

Minkoff et al.

[11] 4,380,334

[45] Apr. 19, 1983

[54] ELECTRONIC CARD GAME SIMULATOR

[75] Inventors: Michael D. Minkoff; Raymond W. Kaestner, both of Torrance, Calif.

[73] Assignee: Mattel, Inc., Hawthorne, Calif.

[21] Appl. No.: 132,755

[22] Filed: Mar. 24, 1980

[51] Int. Cl.[3] ..... A63F 1/00

[52] U.S. Cl. ..... 273/1 E; 340/323 R; 364/411

[58] Field of Search ..... 273/1 E, 1 ES, 138 A, 273/148 R, 237, 292; 340/323 R; 358/93; 364/410, 411; 434/138, 129

[56] References Cited

U.S. PATENT DOCUMENTS

| | | | |
|---|---|---|---|
| 3,201,122 | 8/1965 | Horwitz | 434/129 |
| 3,796,433 | 3/1974 | Fraley et al. | 273/292 |
| 3,876,208 | 4/1975 | Wachtler et al. | 273/138 A |
| 3,889,956 | 6/1975 | Castle | 273/138 A |
| 3,962,800 | 6/1976 | Feldheim | 273/138 A |
| 4,052,057 | 10/1977 | Castle | 273/138 A |
| 4,093,215 | 6/1978 | Ballard | 273/1 ES |
| 4,173,342 | 11/1979 | DeCorlieu-Ferran | 273/148 R |
| 4,249,735 | 2/1981 | Bromley | 273/94 |
| 4,339,134 | 7/1982 | Macheel | 273/1 ES |

OTHER PUBLICATIONS

*The Way to Play,* Paddington Press Ltd., 1975, pp. 110, 111.

*Primary Examiner*—Vance Y. Hum

*Attorney, Agent, or Firm*—Reagin & King

[57] ABSTRACT

A portable electronic card game simulator having a housing mounting a display and input keys and containing electronic data processing circuitry organized to provide the automatic play of a hand of Gin Rummy in opposition to an operator. The simulator deals a hand to the operator and to the electronic opponent. The play of the electronic opponent is controlled by circuitry to simulate the play of a human in accordance with the rules of the game. The simulator includes circuitry for determining the presence of runs, of cards of the same value, and of the value of cards left in a hand.

6 Claims, 13 Drawing Figures

ELECTRONIC CARD GAME SIMULATOR

BACKGROUND OF THE INVENTION

This invention relates to games, and more particularly, to electronic games for simulating the play of card games. The invention is an improvement on the invention of U.S. Patent Application Ser. No. 108,880, filed Dec. 31, 1979, now U.S. Pat. No. 4,314,336, entitled ELECTRONIC CARD GAME SIMULATOR, assigned to the assignee of this invention.

People appear to have been involved in the playing of games since the beginning of recorded history. The almost universal interest in games seems to be due to the excitement engendered by competition, chance, and the increased return to a player as his skill increases.

Competitive games are more exciting, other factors being equal; but, of course, they require that more than one person be involved in each such game.

Recently, various improvements in electronic circuitry have allowed the reduction of circuit size and have led to electronic circuits which simulate the play of a competitor in certain well known games. In these electronic games, a person plays against an electronic competitor thereby eliminating the necessity for other players. The first of these games to be devised were quite expensive and required a television set for a display.

A number of portable electronic games have recently been devised by which a person may play a particular simulated sports game such as football or basketball. These portable games have their own built-in displays and are much less expensive, in general, than those which must be connected to a television set. Furthermore, their small size allows them to be carried about and used almost anywhere. However, these portable electronic games have relatively small displays, contain a limited amount of circuitry, and must be powered by battery. Consequently, the portable electronic games heretofore devised have been relatively unsophisticated. For example, many portable electronic games do not allow the actual play of the game but only of a game which imitates the actual game in broad outline.

It is, consequently, an object of this invention to provide a new and improved electronic card game simulator.

It is another object of this invention to provide a new and improved electronic game capable of simulating the play of a hand in the game of Gin Rummy and of recording and displaying the results of the game.

It is another object of this invention to provide an electronic Gin Rummy game operable at different skill levels.

SUMMARY OF THE INVENTION

The foregoing and other objects of the invention are accomplished by a portable electronic card game simulator which has an exterior housing mounting a display upon which the various cards, hands, and results are presented. The housing also mounts input keys for controlling the operation of the game and contains electronic data processing circuitry organized to provide the automatic play of two skill levels of Gin Rummy. In playing each of the skill levels of the game, a hand is dealt to the human operator and to the electronic opponent; and the play of the electronic opponent is controlled to simulate the play of a human in accordance with the rules of the game.

In particular embodiments, the control of the computer opponent includes circuitry for determining the presence of runs, of cards of the same value, and of the value of cards left in a hand after each turn. The electronic circuitry also has arrangements for checking compliance with the rules of the game and for controlling the display to show the cards held in the operator's hand, the status of the game, and the scores of the operator and his electronic opponent.

Other objects, features, and advantages of the invention will become apparent by reference to the specification taken in conjunction with the drawings in which like elements are referred to by like reference designations throughout the several views.

DESCRIPTION OF THE PREFERRED EMBODIMENT

Figure 1:
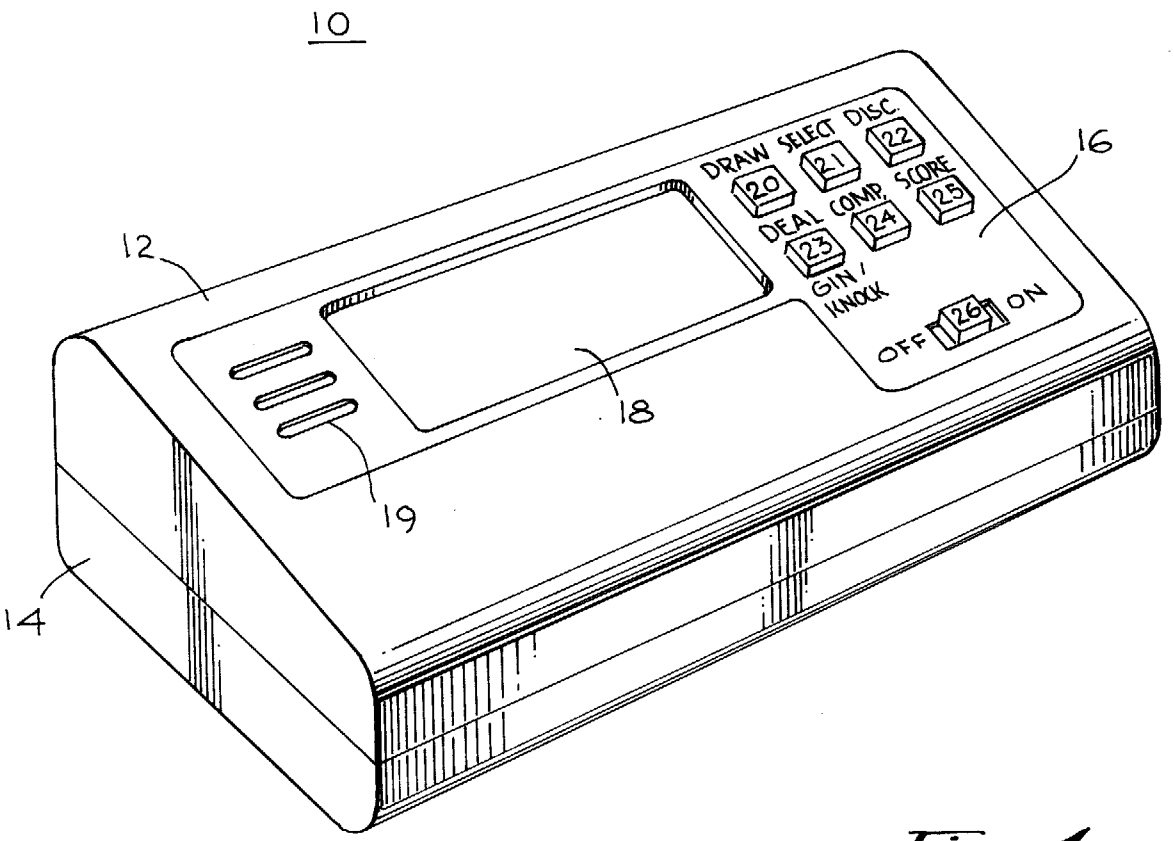
FIG. 1 is a perspective view of the exterior of a housing containing an electronic card game simulator constructed in accordance with the invention.

Referring now to the drawings and, more particularly, to FIG. 1, there is shown a perspective view of an electronic card game simulator 10 constructed in accordance with this invention. The simulator 10 includes an upper housing 12 and a lower housing 14 each of which may be constructed of a moldable plastic material. The housings 12 and 14 may be joined together in a conventional manner to form a hollow interior for containing electronic components. The upper housing 12 mounts a control panel 16 which includes a display 18, a speaker 19, and input keys 20 through 26. The input key 20 is designated "draw"; the input key 21, "select"; the input key 22, "discard"; the input key 23, "deal/gin/knock"; the input key 24, "comp"; the input key 25, "score"; and the input key 26, "off-on." On the bottom of lower housing 14, but not shown in FIG. 1, is a door for providing access for insertion of conventional batteries, such as a nine volt transistor battery, to operate the circuitry contained within the housing halves 12 and 14 of the simulator 10.

Figure 2:
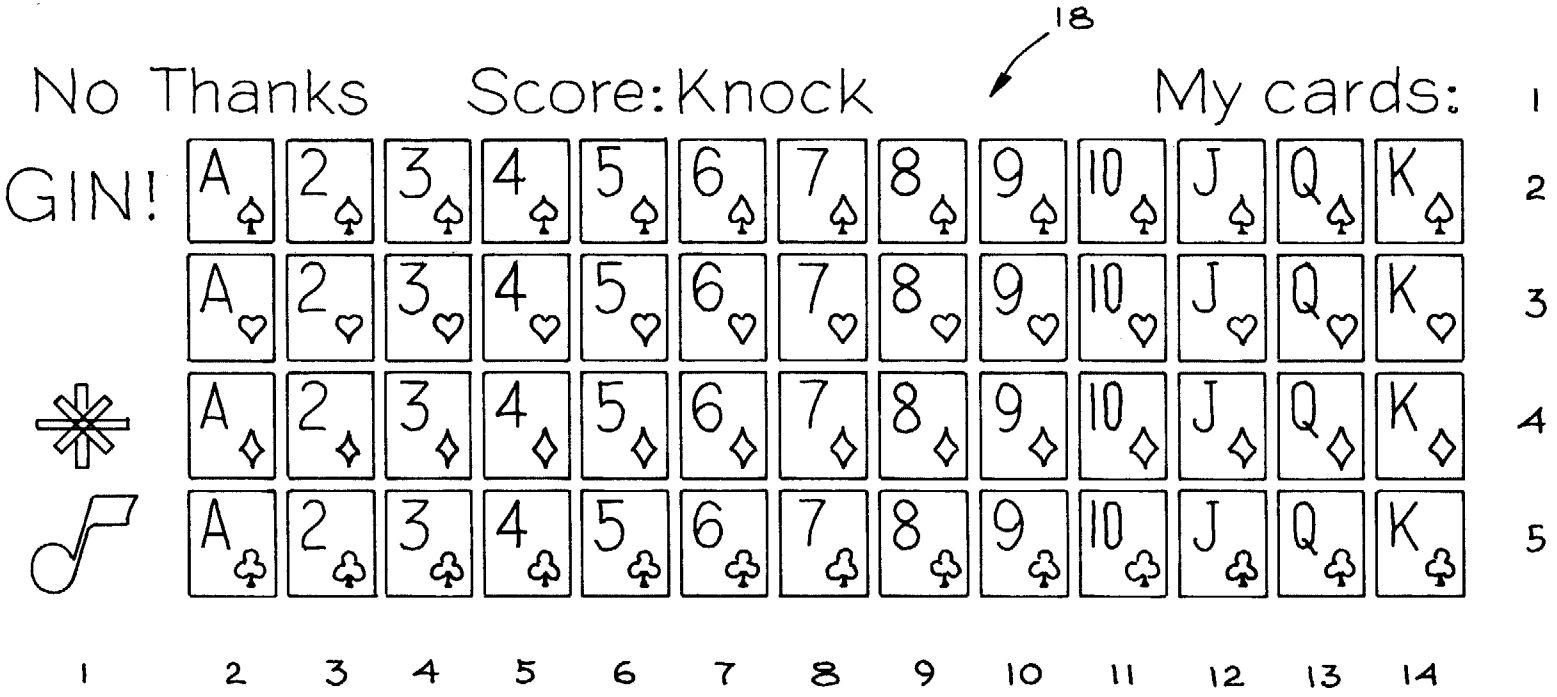
FIG. 2 is a diagram illustrating an arrangement by which information is presented on the display of the housing shown in FIG. 1 in a preferred embodiment.

Referring now to FIG. 2, there is shown a diagram of the information presented in a preferred embodiment by the display 18 of the simulator 10. In a preferred embodiment, the display 18 is a liquid crystal display. As will be noted, the display 18 has five rows designated 1 through 5 at the right-hand edge of the drawing and fourteen columns designated 1 through 14 at the bottom of the drawing. Row 1 contains the words: "No", "Thanks", "Score", "Knock", and "My Cards." Row 2 contains the word "Gind!" and the thirteen spades from ace through king. Row 3 begins in column 2 and includes the thirteen hearts in the sequence ace through king. Row 4 has an "*" followed by the thirteen diamonds in the sequence ace through king, and Row 5 has a musical note followed by the thirteen clubs in the order ace through king.

Any of these indications may be selected and displayed singly or with other indications in a manner well known to the prior electronic art by designating a particular row and column at which such indication lies. For example, the eight of hearts is selected by designating row 3, column 9. The particular indications displayed at each step of the operation of the simulator 10 will be explained in the following description of the operation of the simulator 10. It should be noted that the display 18 shown in FIG. 2 has cards of the same kind arranged in the same column; because of their physical position in the display, cards of the same kind are often described herein as "vertical runs."

Figure 3:
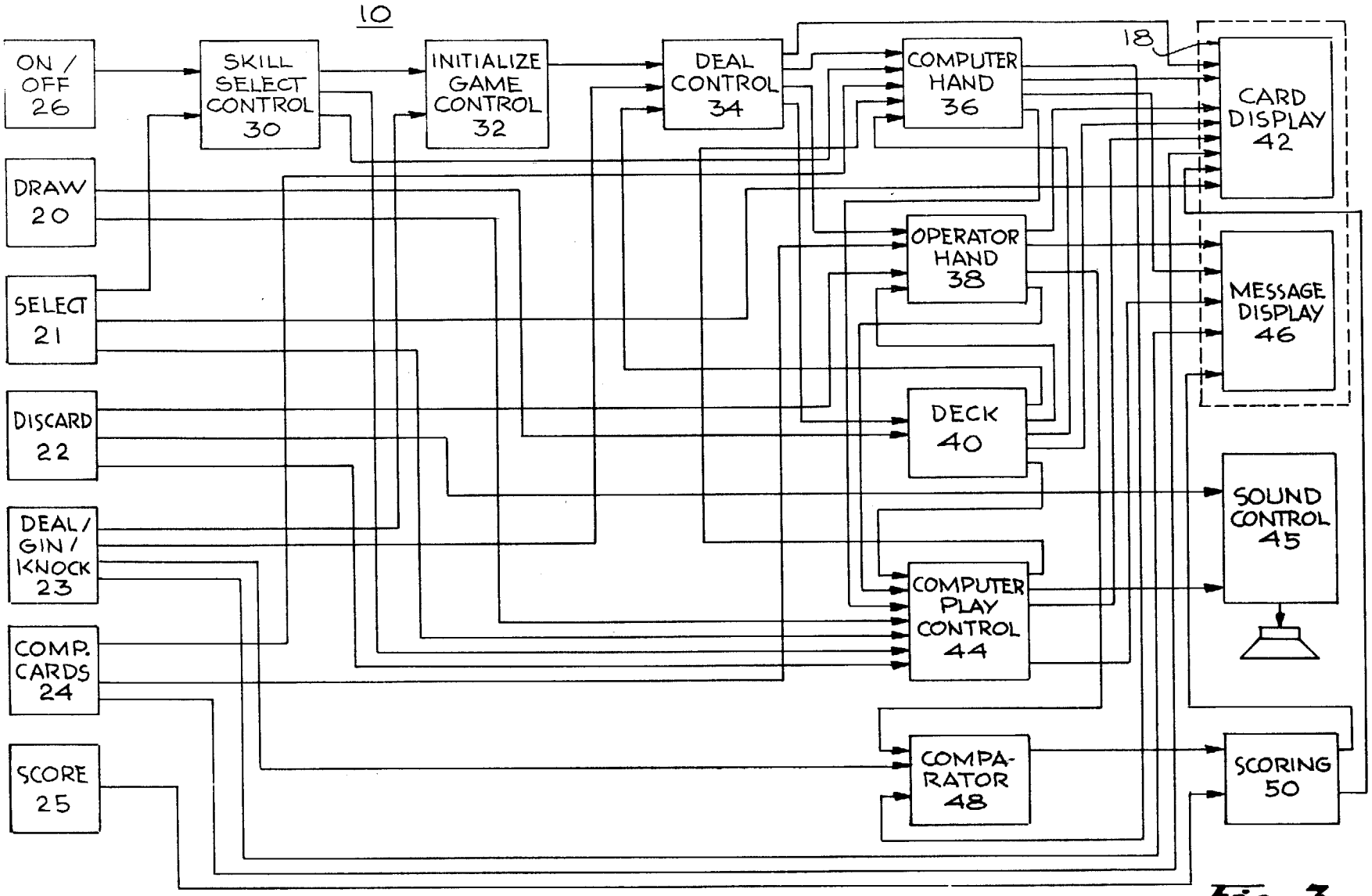
FIG. 3 is a logical block diagram of the card game simulator of the invention for playing Gin Rummy.

Referring now to FIG. 3, there is shown a logical block diagram of the simulator 10 constructed in accordance with the invention. At the extreme left of FIG. 3 are positioned each of the input keys (or switches) 20 through 25 described in FIG. 1. The energization of the simulator 10 by means of the on-off switch 26 furnishes an input signal to a skill select control 30 which provides a signal to an initialize game control 32 for initializing each of the two skill levels of the game which may be played by the simulator 10. The initialize game control 32 provides an input signal to deal control 34 which controls the method of dealing cards to each of a computer hand 36 and a human operator hand 38. The deal control 34 provides signals directly to the computer hand 36, to the operator hand 38, and to a deck 40. The deal control 34 is also connected to provide input signals to a card display 42 which represents the card portion of the display 18. The computer hand 36 and the operator hand 38 also provide signals to the card display 42 so that after the deal and at various times during each game, the operator hand, the face up card, and the computer hand may be displayed. The deck 40 is also connected to provide signals to both the computer hand 36 and the operator hand 38 so that cards may be drawn from the deck 40 during the play of the game.

The other input keys 20 through 25, which provide means by which the operator may play his hand, are variously connected to the circuitry of the simulator 10 to allow that result. For example, the draw key 20 is used in the play of the game in order to draw a card from the deck. The draw key 20 is therefore connected to provide an input signal to the deck 40 and a second input signal to a computer play control 44 which controls the play of the computer hand 36 during each game. The computer play control 44 provides direct output signals to control the computer hand 36 and also provides output signals to the card display 42 and a message display 46 which displays those portions of the display 18 illustrated in FIG. 1 other than the cards. The message display 46 also receives input signals from the computer hand 36 and from the operator hand 38.

The select input key 21 is used for a number of purposes. First, it is used to select the particular skill level of the game to be played and for that purpose is connected to the skill select control 30. In addition, the select input key 21 is also used to help indicate which card is to be discarded in particular games and for that purpose is connected to both the card display 42 and to the computer play control 44.

The discard input key 22 is used with the select input key 21 to select cards to be discarded and is, therefore, connected to the operator hand 38 and to the computer play control 44. The discard key 22 also energizes a sound control 45 which functions to emphasize various aspects of the game play. For example, in a preferred embodiment the sound control 45 provides under the direction of the computer play control 44 a short tone each time the power switch 26 is closed, each time one of the keys 20–25 is depressed correctly, each time a hand of cards is displayed on the display 18, each time the word "Thanks" is displayed, and each time the points and cumulative score are displayed. The sound control 45 also provides two short tones with the words, "No Thanks"; to beeps with the declaration of "Knock"; three short tones with the declaration of "Gin!"; a short tone followed by a trill with an incorrect declaration of "Knock"; and a long tone when the cumulative points for a player pass one hundred. In various embodiments signals may have different frequencies to add to the game interest.

The deal/gin/knock input key 23 is used initially to cause cards to be dealt to both the computer hand 36 and the operator hand 38. Consequently, it is connected to the initialize game control 32 and to the deal control 34. The deck 40 receives an input signal from the deal control 34 and provides output signals by which the computer hand 36 and the operator hand 38 are dealt selected cards. The deck 40 also provides output signals to the card display 42 and the computer play control 44. For certain purposes, the deck 40 also provides a signal to the deal control 34.

The input key 23 is also connected to the message display 46 of the display 18, and to a comparator 48 which is used to determine whether the rules of the game have been complied with. For example, when the input key 23 is also used by the operator to signal that he believes that his hand contains ten or less points (i.e. knock) or gin, the comparator 48 receives input signals from the computer hand 36 and the operator hand 38 so that it may review the cards held by each to determine whether in fact a gin is present and to count the points in the hands when gin and knock are signalled. The comparator 48 provides signals to a scoring control 50 which provides signals to the card display 42 and the message display 46 to control the display of the appropriate scoring messages.

The computer cards input key 24 is connected to the computer hand 36 and to the card display 42 so that at the end of the game the cards held by the computer hand 36 may be displayed on the display 18. H is also connected to the operator hand 38, so that at the end of the game the operator hand 38 may also be displayed on the display 18, alternating with the computer hand 36.

The score input key 25 is connected to the scoring control 50 to initiate an indication of the score of the game on the display 18.

Figure 4:
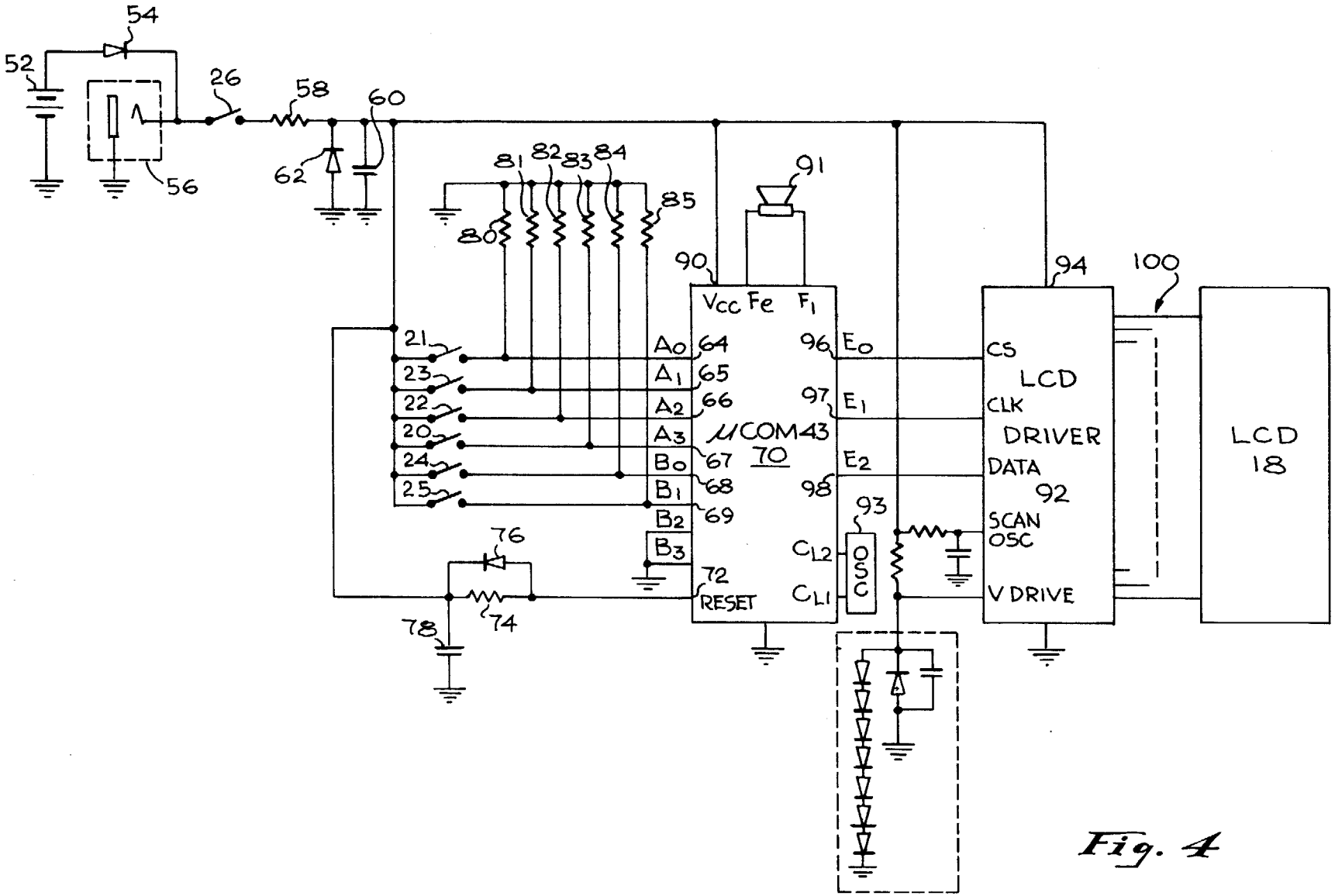
FIG. 4 is a schematic diagram of circuitry utilized in a preferred embodiment of the invention.

Referring now to FIG. 4, there is shown a schematic circuit diagram of a circuit which may be utilized to implement the block diagram illustrated in FIG. 3. As may be seen in FIG. 4, a battery 52, which may be a standard 9-volt transistor battery supplies power through a diode 54 to the off-on switch 26. An adaptor jack 56 is also connected to the switch 26 to allow the circuit to receive power from a conventional transformer (not shown) which may be connected to a house power supply. The switch 26 supplied the power to the remainder of the circuitry via a resistor 58 which is connected to ground by a capacitor 60 and a zener diode 62. The zener diode 62 provides a regulated supply voltage of five volts to the rest of the circuit. The resistor 58 is connected to each of the switches 20 through 25 and thereby to a set of input terminals 64 through 69, respectively, of a circuit 70. The resistor 58 is also connected to a reset terminal 72 of the circuit 70 by means of a resistor 74 connected in parallel with a diode 76. The reset terminal 72 is grounded through a capacitor 78.

When any one of the switches 20 through 25 is closed, it results in the particular input terminal 64–69 of the circuit 70 being connected to the regulated supply voltage of five volts. This voltage provides a current to ground through the selected one of a number of resistors 80 through 85 thereby causing the voltage to be applied to the particular input terminals 64 through 69 of the circuit 70. Operating voltage is also applied from the battery 52 via the resistor 58 to the circuit 70 at a terminal 90 and to a conventional liquid crystal display driver circuit 92 at a terminal 94. A speaker 91 is connected to provide the sound output described above, and an oscillator 93 generates clock pulses for the circuit 70. The circuit 70 provides signals at terminals 96, 97, and 98 for operating the L.C.D. driver circuit 92. The L.C.D. driver circuit 92 provides a number of signals generally indicated as 100 for operating the liquid crystal display circuits of the message display 18.

As will be understood by those skilled in the computer art, the circuit 70 may be implemented in any of a number of different ways. However, as with many prior art electronic game circuits, the preferred embodiment of the invention utilizes an integrated circuit microprocessor (a miniature digital electronic computer) preferrably constructed on a single chip. Such integrated circuits are well known and include all of the input, output, memory, logic, and control circuitry of a special purpose digital computer in miniature form. In general, such circuits have both random access memory (RAM memory) and read only memory (ROM memory). The ROM memory has connections formed by masking operations during the construction of the basic circuitry of the digital computer itself to provide a completely circuit which includes the program for controlling the operation of the microprocessor. Such an arrangement is often described as a dedicated memory circuit. The RAM memory of the circuit is utilized for storage of the various bits of information and program during the operation of the circuitry.

Various such circuits (usually produced on a single chip of material) are offered by a number of manufacturers and are well known to the prior art. A preferred embodiment of the invention utilizes a MicroCom-43 single chip microcomputer manufactured by NEC Microcomputers, Inc. This circuit is a four-bit parallel central processing unit which has a two thousand by eight-bit program ROM memory, a ninety-six by four bit RAM memory, thirty-five input/output channels, a programmable interval timer, interrupt handling circuits, a clock generator, and various control circuits. Additional details of the MicroCom-43 are contained in the User's Manual therefor published by NEC Microcomputers, Inc., 173 Worcester St., Wellesley, Mass.

The general operation of the simulator 10 will now be explained with reference to FIG. 3. When power is initially applied to the circuit through the operation of the of-on switch 26, the simulator 10 activates skill select control 30 to place the game in a state to provide play of one of two distinct skill levels of play which will be referred to hereinafter as Gin 1 and Gin 2. In the preferred embodiment, Gin 1 is the first game offered. In the preferred embodiment, the card display 42 and the message display 46 indicate which of the two levels is ready to be played by the following indications: "Gin!" and the ace of spades is lit to indicate Gin 1, "Gin!" and the deuce of spades is lit to indicate Gin 2. Thus, "Gin!" and the ace of spades is lit initially.

Depressing the select key 21 once with the power on before a hand is played operates the skill select control 30 to select a different skill level to be played. The selection of the particular skill level by means of the skill select control 30 causes the initialize game control 32 to set the simulator 10 to a state such that the game may begin by initializing the deal control 34, and sends signals to the comparator 48 and the computer game play control 44 so that they are actuated to perform in accordance with the particular skill level selected.

If either Gin 1 or Gin 2 is selected, the game proceeds as follows. The operator depresses the deal input key 23 which causes the previously initialized deal control 34 to deal at random ten cards to the computer hand 36 and ten cards to the operator hand 38. The deal control 34 includes among other things, a random card generator, the construction of which will be obvious to those skilled in the art.

After dealing the hands, the deal control 34 causes a card to be dealt which is considered to be the face up card. This card is indicated by causing it to flash on and off in the display 18 shown in FIG. 2. At the same time, the deal control 34 causes the card display 42 to display continuously those cards which are contained in the operator hand 38. Play proceeds from this point with the human operator taking the first turn. As in the card game of Gin Rummy, the operator may pick up the face up card or draw a card from the deck. The operator chooses the face up flashing card by depressing the select input key 21. This causes the flashing card to remain lit constantly and one of the other cards in the operator hand 38 to begin flashing. The operator may discard the new flashing card by depressing the discard input key 22. If he does not wish to discard, the operator continues depressing the select button 21; and each of the cards in the operator hand 38 flashes in turn on the card display 42. When the operator reaches the card he wishes to discard, the operator ceases pressing the select key 21 and presses the discard input key 22. This causes the card presently flashing to disappear from the card display 42 and from the operator hand 38.

Instead of picking up the face up card, the operator may wish to draw from the deck 40. If so, the operator presses the draw input key 20, causing the initially flashing face up card to disappear from the card display 42 and the deck 40 to deal a new card which appears as a new flashing card on the display 42. The operator may decide to discard this flashing card by pressing the discard input 22, or he may retain this card and operate the select input 21 to step through the other cards in his hand until he reaches the card he wishes to discard. At this point, the operator discards the selected flashing card by pressing the discard input key 22.

It is conceivable that the operator will, after his discard, have only runs and cards of the same value in his hand (i.e. a perfect Gin Rummy hand) or less than ten unmatched points (i.e. a knock hand). Unmatched points are those in neither a horizontal or veritcal run. It should be noted here that Gin is a special knock hand in which the unmatched point total is zero. If so, the operator then presses the Deal/Gin/Knock input key 23 which causes the comparator 48 to read the output of the operator hand 38 to determine how many points remain therein. If no points remain so that a perfect gin hand is present, the comparator circuit 48 signals the scoring circuit 50 to display the word "Gin!" on the message display 46 of the display 18 and to award bonus points to the operator. A player receives twenty bonus points for gin plus the count of unmatched points in the opponent's hand, counting the ace through ten of a suit as one through ten points, respectively, and all of the other face cards as ten points.

If the comparator 48, on the other hand, determines that the operator hand 38 does not contain a perfect gin hand but has ten or less unmatched points, the comparator 48 also reviews the computer hand 36 and counts its points. The word "knock" and the unmatched points of both hands are shown by display 18. If the computer hand 36 has the same number or more points than the operator hand 38, the scoring circuit 50 adds to the operator's cumulative score a score equal to the difference in points between the hands. If the computer hand 36 has less unmatched points, the display signals "knock", shows the unmatched points in both hands, and awards the computer hand 36 the difference in points plus ten bonus points in the cumulative score. If the operator does not have less than ten unmatched points, the display 18 signals "No Knock" and awards the game to the computer, adding twenty bonus points to its score.

Presuming that the operator does not have gin or less than ten unmatched points upon picking up his first card, the operator presses the discard input key 22 and the computer opponent begins its turn. To the operator, it appears that the computer plays instantaneously; for the flashing card discarded by the player disappears and a new flashing card appears as the computer either picks up the flashing discard or covers it with the computer discard. In any event, the computer has played and discarded a new card. If the "*" lights up on the message display 46, the computer drew from the deck and the new flashing discard came from the computer hand 36. If the word "Thanks" lights up, the computer took the operator's discard. If "No Thanks" lights up, the computer drew a card from the top of the deck and discarded that card or another card from its hand. The "*" is also used to designate a Gin or Knock in the computer hand 36. Thus, the following combinations may occur upon the computers turn:

"No Thanks"—the computer refused the operator's discard and drew a card; the computer then refused this card, and it is the new face up card.

"No Thanks *"—the computer refused the operator's discard and drew a card which it accepted and discarded another card from the computer hand 36.

"No Thanks * Gin!"—the computer refused the operator's discard and drew a card which is accepted, but upon discarding it has a gin.

"No Thanks * KNOCK"—the computer refused the operator's discard and drew a card which is accepted, but upon discarding it has less than ten unmatched points.

"Thanks"—the computer accepted the operator's discard and discarded another card from its hand.

"Thanks * GIN!"—the computer accepted the operator's discard and upon discarding another card from its hand has gin.

"Thanks * KNOCK"—means that the computer accepted the operator's discard and upon discarding another card from its hand has less than ten unmatched points.

Presuming that the computer does not have gin or less than ten unmatched points at this time, the play then returns to the operator and alternates between the operator and the computer until one of the two obtains gin or less than ten unmatched points. During the entire operation, the play of the computer hand 36 is controlled by the computer play control 44. In controlling the play of the game by the computer hand 36, the computer play control 44 looks for runs, cards of the same kinds, and less than ten unmatched points. Upon reaching a gin or any hand of less than ten unmatched points, the computer hand 36 immediately displays this fact.

Figure 5:
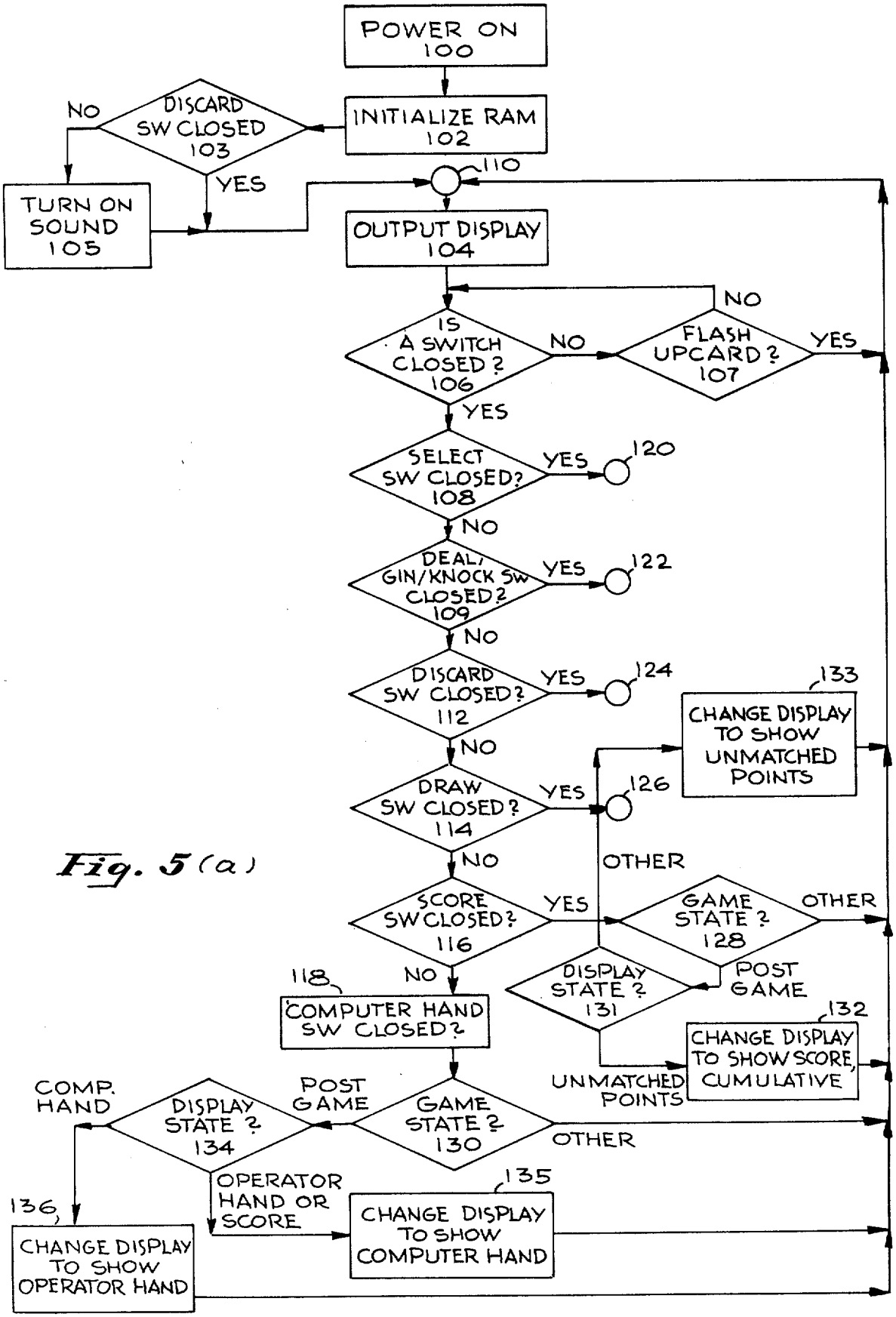
FIGS. 5(*a*)–5(*g*) together comprise a flow chart illustrating the sequence of operations performed by the circuitry of the electronic card game simulator of this invention in playing Gin Rummy.
Figure 5B:
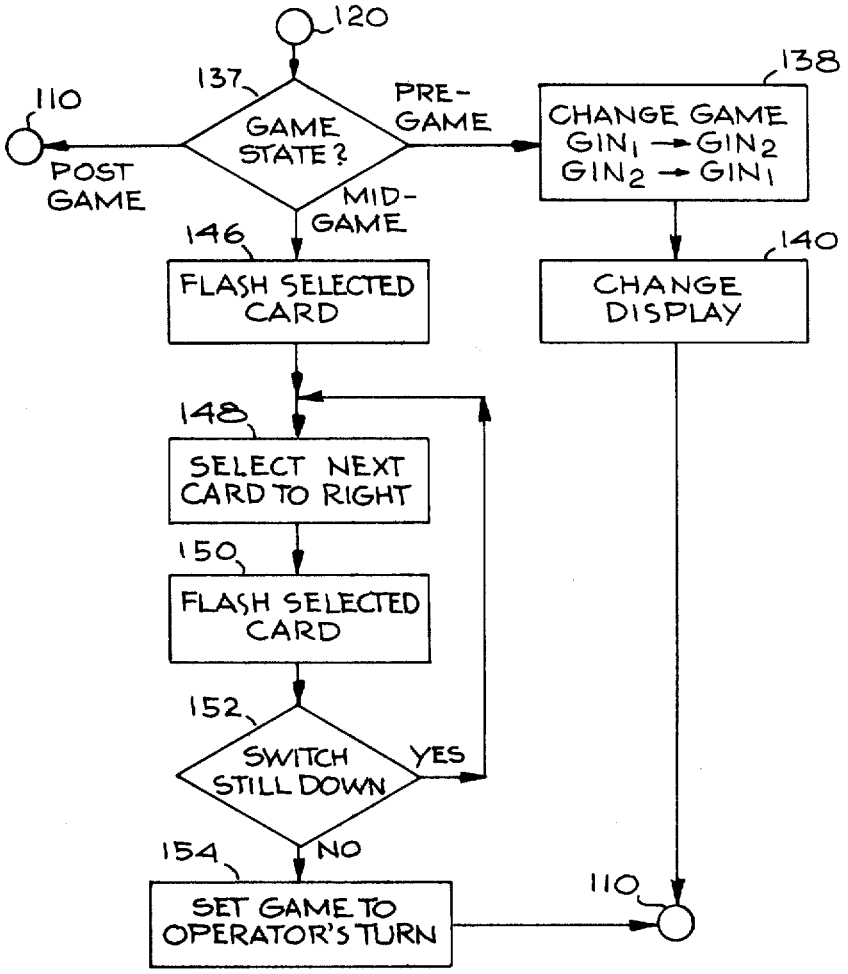
Figures 2, 5G:
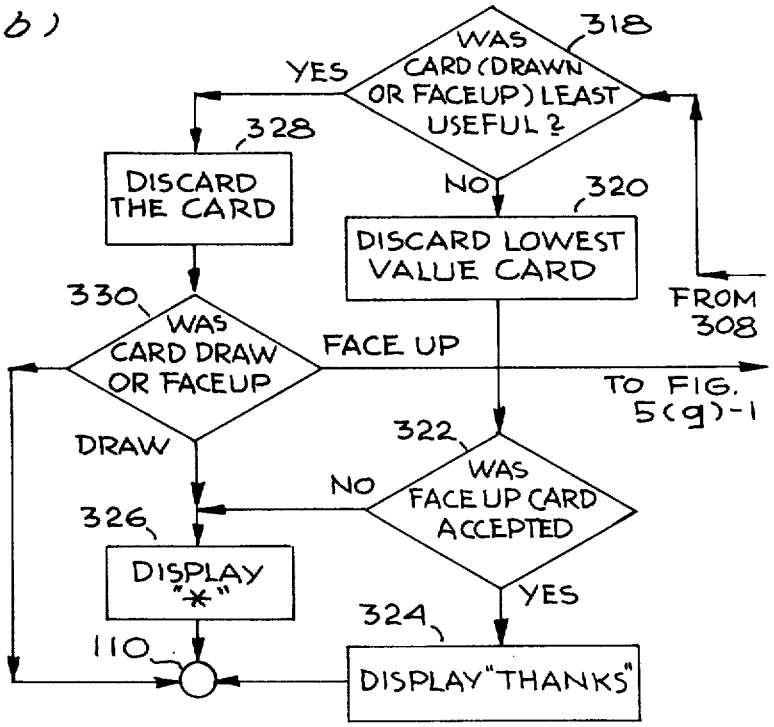
Figure 5C:
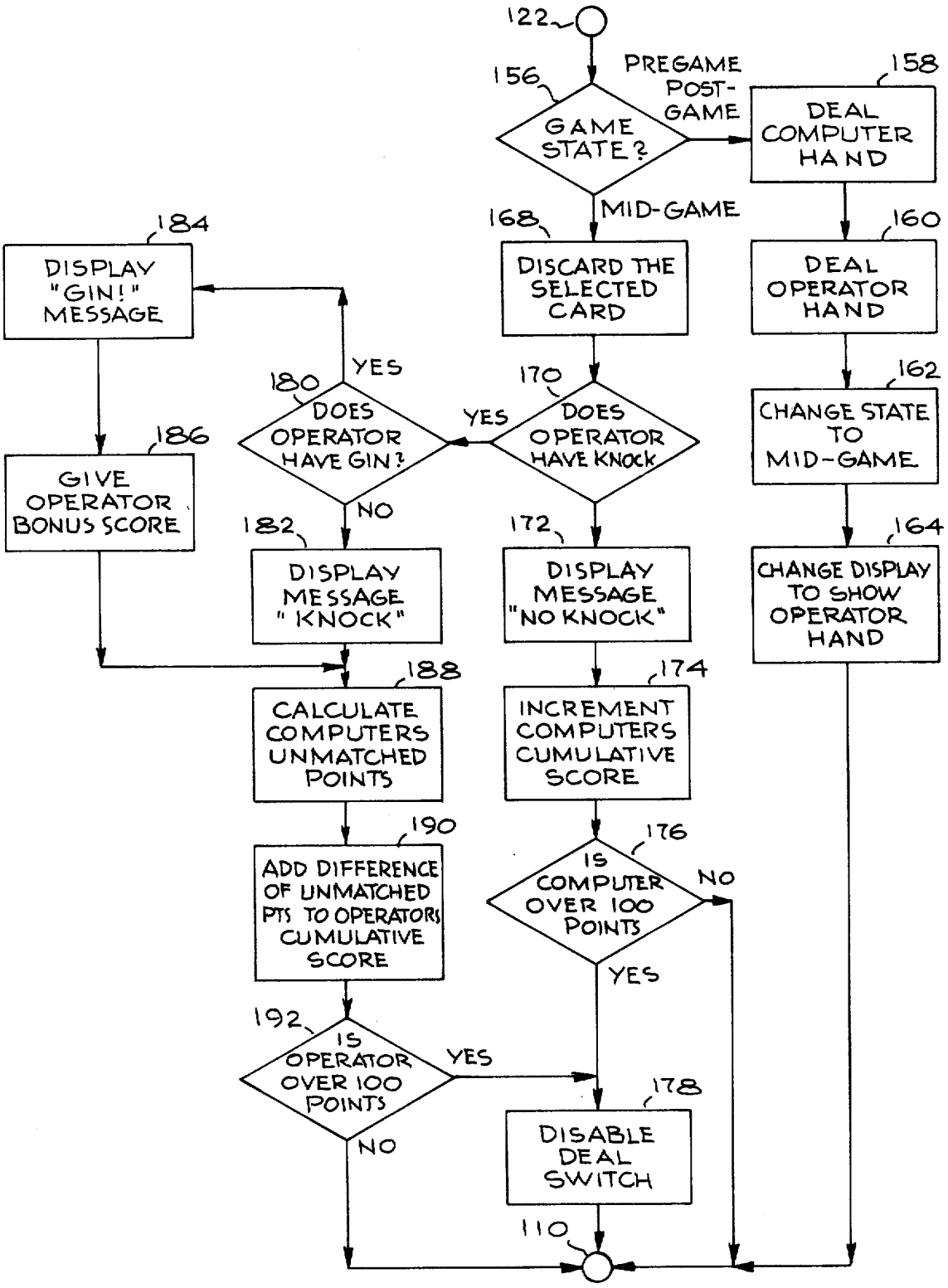
Figures 1, 5D:
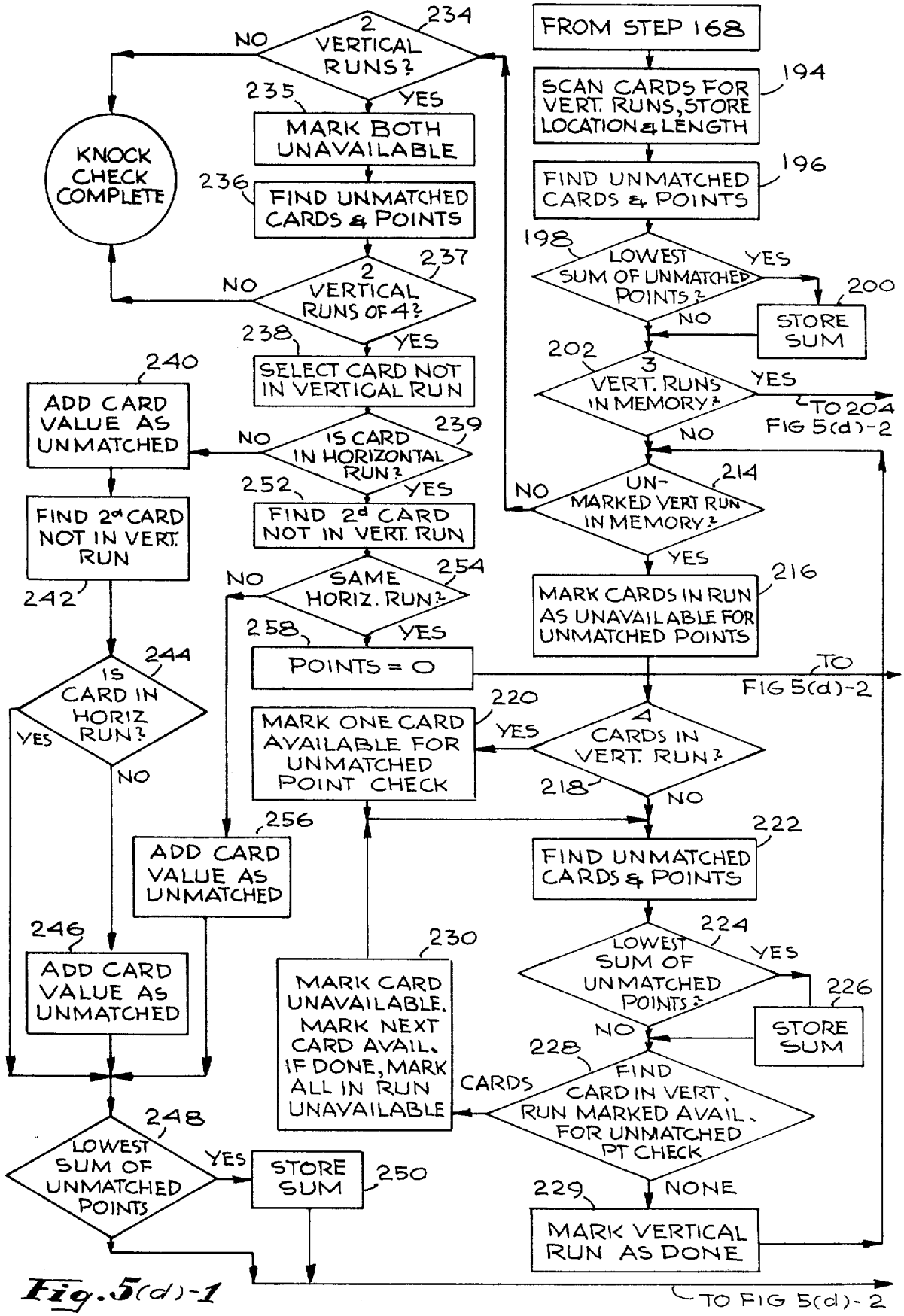
Figures 2, 5D:
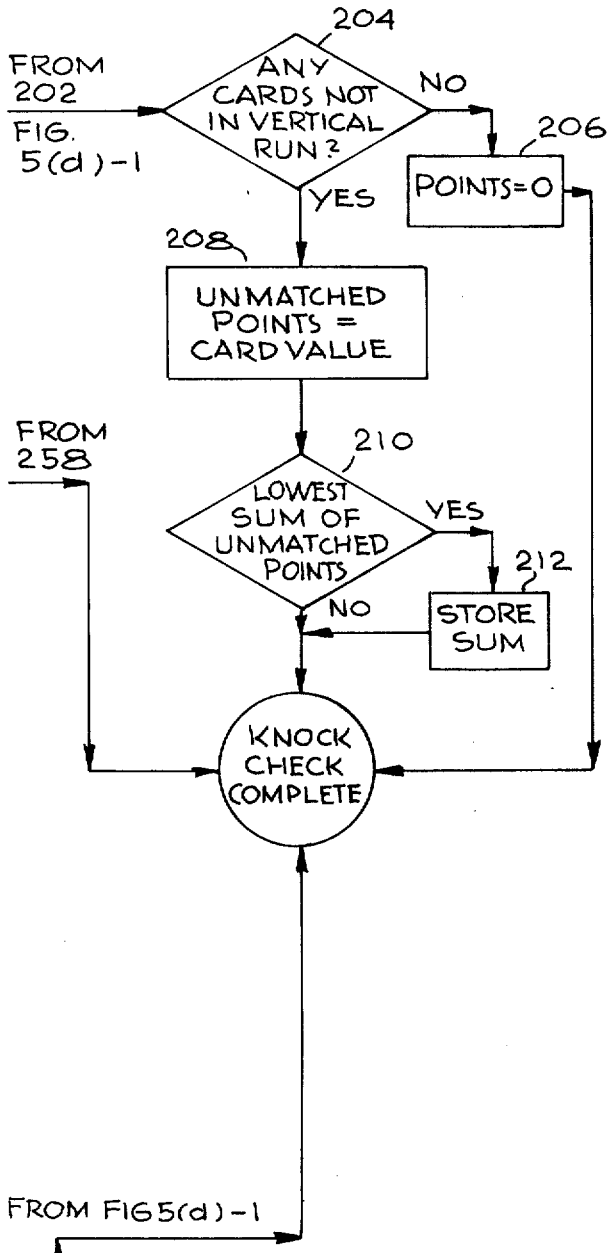
Figure 5E:
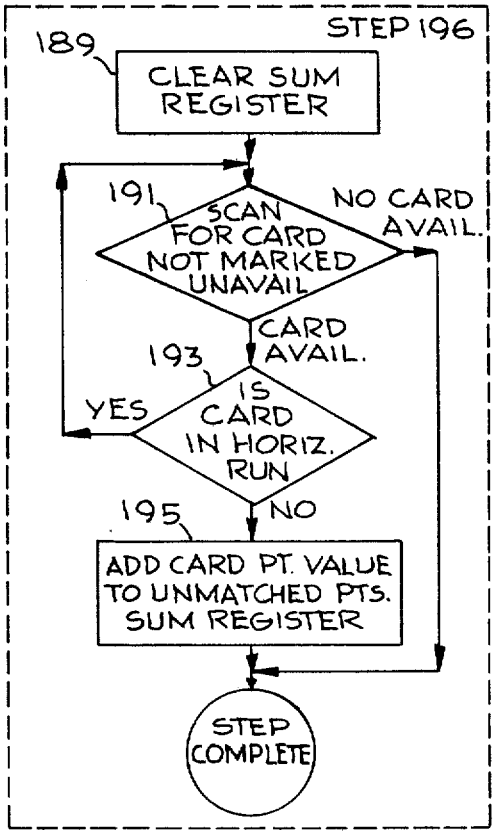
Figure 5F:
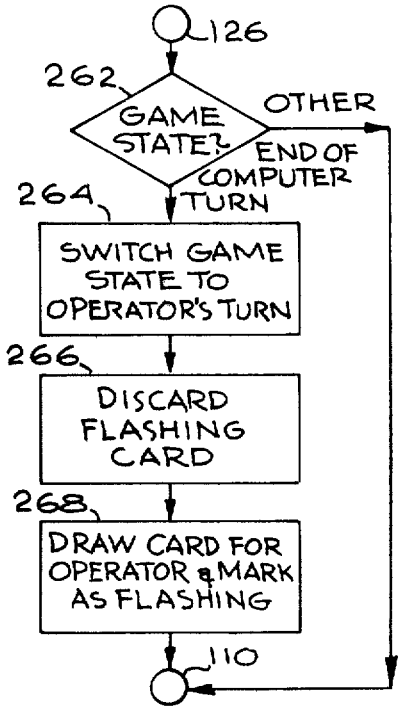
Figures 1, 5G:
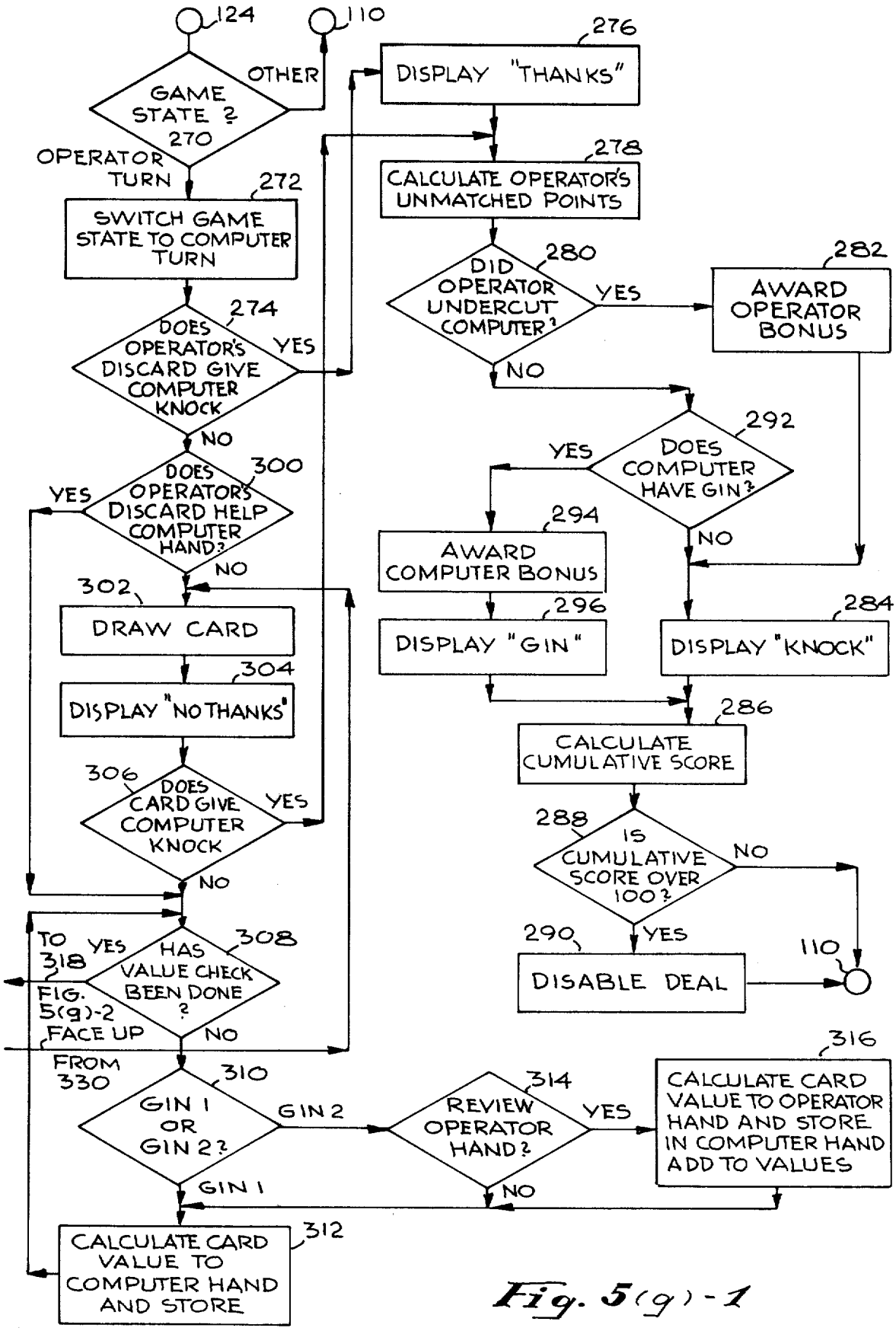

As will be noted in the description of FIG. 5 which follows, the computer play control 44 and the comparator 48 check to determine whether a gin occurs with each new card selection by the computer hand 36 from either the deck 40 or the discard.

Once the operator hand 38 or the computer hand 36 has been found to have Gin Rummy or less than ten unmatched points, the machine displays the operator's ending hand. The operator may obtain the score at this point by pressing the score input key 25. This will first display both players' unmatched points; and, finally the cumulative score. In the preferred embodiment, row 2 of the display 18 shows the operator's tens, row 3 the operator's ones, row 4 the computer's tens, and row 5 the computer's ones. Thus, the lighting of the four of spades, the three of hearts, the two of diamonds, and the ace of clubs signifies that the operator leads the computer, forty-three to twenty-one.

The operator may also determine the final computer hand 36 against which he was playing by pressing the computer cards input key 24. This causes the computer hand to be displayed with the words, "My Cards." If he presses the input key 24 a second time, he will see his own hand again. To deal a second hand of Gin Rummy, the deal/gin/knock input key 23 is pressed causing the deal control 34 to deal a second hand. The game then proceeds as described above.

Referring now to FIG. 5(*a*) through 5(*e*), there is disclosed a flow chart which describes the operation of the preferred embodiment of the simulator 10 described herein. FIG. 5(*a*) shows those steps through which the program of the simulator 10 passes in operation in response to the operation of the input switches 20 through 26.

When the power is turned on at step 100 by the closure of the off-on switch 26, the random access memory is initialized at step 102. The program then moves to decision step 103 to determine whether the discard switch 22 has been closed. The discard switch 22 is used to enable and disable the sound control 45 so that sound may be turned on or off. If switch 22 has been closed and sound is not to be included, the program moves to step 104 to cause the display 18 to provide an output at step 104 signifying that sound is off and indicating the particular skill level of the game to which the simulator 10 is first set when the power is turned on. In the preferred embodiment, a musical note on the display 18 indicates that the sound is turned on while the absence of the note shows the sound is turned off. The preferred embodiment of the simulator 10 also first plays Gin 1. If the discard switch 22 has not been closed, the program moves to step 105 to enable the sound control 45 and then to step 104 to display the musical note and the Gin 1 indication.

After step 104, the program inquires at step 106 whether one of the input switches (keys) 20 through 25 is closed and, if none is closed, inquires at step 107 whether the face up card should be flashed. This is determined in accordance with the rules of Gin Rummy; and when the power is initially applied, no card is flashing. However, during the play of the game, the program is recirculated from time to time to junction step 110 to determine if the face up card should be flashed. If no card should be flashed in accordance with the rules of the game, then the program returns to step 106. If a card should be flashed, the display 18 is updated to flash this card at step 104; and the program moves to step 106.

If at step 106 it is determined that a switch is closed, the program functions to determine whether the select switch 21 is closed at step 108, whether the deal/gin/knock switch 23 is closed at step 109, whether the discard switch 22 is closed at step 112, whether the draw switch 20 is closed at step 114, whether the score switch 25 is closed at step 116, or whether the computer hand switch 24 is closed at step 118. If any one of these switches has been closed, the program is diverted to one of the junction points 120, 122, 124, or 126 or to steps 128 or 130, respectively. If at any step inquiring as to the condition of an input switch 20–25 it is determined that the particular switch has not been operated, then the program moves to inquire as to the condition of the next switch in order. For example, in FIG. 5(*a*), if none of the select, deal, discard, or draw switches 21, 23, 22, 20 have been depressed and the score input switch 25 is depressed, the program moves to step 128 to inquire as to the game state, and if it is other than post-game, returns to step 110. If the game state is after the completion of the play of a hand, then the program steps to step 131 to determine the state of the display 18. If the display is presently showing unmatched points, the program moves to step 132 to advance the display 18 to show the cumulative score. If the display 18 is showing the cumulative score, the program moves to step 133 to advance the display 18 to show the unmatched points. After either of steps 132 or 133, the program returns to step 110 and step 104 to cause display 18 to indicate the selected output and then on to determine the condition of the various switches.

If on the other hand, none of the select, deal, discard, draw, or score input switches 21, 23, 22, 20, 25 have been depressed, the program proceeds to step 118 where it presumes that the computer hand switch 24 has been depressed (since this is the only switch remaining) and inquires at step 130 what state the game is in. If the state of the game is other than after the completion of a hand, the program returns to step 110 because the computer hand cannot be displayed except after the completion of a hand. If the hand has been completed, then the program proceeds to step 134 at which the state of the display 18 is determined. If the display 18 is showing the operator hand 38 or score, the display 18 is changed at step 135 to show the final computer hand 36 in the play of the hands. If the display 18 is showing the computer hand 36, the display 18 is changed at step 136 to show the final operator hand 38. Thereafter, the program moves to step 110 to recirculate through the switch determination steps.

FIG. 5(*b*) illustrates the operation of the simulator 10 when it is determined that the select switch 21 has been depressed and the program moves to the junction step 120. At this point, the program proceeds to a decision step 137 to determine the game state. If the state of the game is before the first hand has been played, then depression of the select key 21 means that the game skill level should be changed to the other skill level. In such a case, the program proceeds to step 138 where the game is changed (in the preferred embodiment) so that if Gin 1 was previously selected for play, Gin 2 is not selected for play; and if Gin 2 was previously selected for play, Gin 1 is selected for play. The program then proceeds to step 140 to change the display 18 to indicate the particular skill level of the game being played ("Gin" and the ace or deuce of clubs) and recirculates to junction step 110.

If, on the other hand, the game is at mid-game, the select key 21 is used to select the card which is to be discarded from the operator's hand; and the program proceeds from step 137 to step 146. At this point, one of the cards is being flashed on and off; and the further depression of the select key 21 means that the next card in sequence should be selected and flashed. This is accomplished at steps 148 and 150 where the next card to the right in display 18 (or the card farthest to the left in the next row if the present card is last in a row) is flashed on and off. The program then moves to decision step 152 to inquire whether the select input switch 21 is still depressed to indicate that yet another card should be selected. If the switch 21 is still depressed, the program recirculates to step 148 to cause the selection of the next card in order to the right and its flashing on the display 18. When the select input switch 21 is ultimately released, the program proceeds to step 154 where the game state is set to the operator's turn and the program is returned to junction step 110.

If at step 137, the game has been completed, the select key 21 has no function, and the program returns directly to step 110.

If in FIG. 5(*a*) it has been determined at step 109 that the deal/gin/knock input switch 23 has been depressed, then the program proceeds via the junction step 122 to step 156 (see FIG. 5(*c*)) in which the game state is determined. The deal/gin/knock key 23 is used to initiate the deal of the hand in each game and to signal that the operator hand has less than ten unmatched points or gin. If the game state is prior to the play of a hand or after the completion of the play of a hand, then depression of the deal/gin/knock switch 23 indicates that new hands are to be dealt; and the program moves to step 158 where the computer hand 36 is dealt, to step 160 where the player hand 38 is dealt, and to step 162 where the game state is changed to mid-game. The program then changes the display 18 at step 164 to display the operator hand 38 and recirculates to step 110.

If the game state is other than pre or post-game, then closing the key 23 indicates that the operator is signaling knock or gin; and the program proceeds to step 168 at which the flashing card in the operator's hand is discarded. From step 168, the program proceeds to step 170 to determine whether the operator has "knock." If the operator does not have "knock" in his hand, the program moves to step 172 to cause the display to indicate "No Knock" then to step 174 to add twenty points to the computer's cumulative score as a bonus because the player incorrectly indicated knock. From step 174, the program moves to step 176 to determine whether there are over one hundred points in the computer's cumulative score. If so, the operation of the game 10 is disabled by disabling the deal/gin/knock switch 23 at step 178. If the computer's cumulative score is not over one hundred points, the program recirculates to junction step 110.

If it is determined at step 170 that the operator has less than ten unmatched points and thus has knock, the program moves to step 180 to inquire whether the operator hand 36 has gin. If the operator hand 36 does not have gin, the output message "Knock" is displayed by display 18 at step 182. If the operator does have gin, the output message "Gin!" is displayed by the display 18 at step 184; and the operator is given a bonus score of twenty points at step 186. In either case, the program moves to step 188 to calculate the computer's unmatched points and to add these unmatched points at step 190 to the operator's cumulative score. The program then moves to step 192 to determine whether the operator's cumulative score is over one hundred points. If it is, the deal/gin/knock switch 23 is disabled at step 178. If it is not, the program recirculates to junction step 110.

FIG. 5(*d*) illustrates the sequence of steps for determining whether a player has, in fact, the correct number of unmatched points in his hand for declaring knock. The flow chart shown in FIG. 5(*d*) describes the steps by which step 170 shown in FIG. 5(*c*) may be accomplished. The program begins after step 168 at step 194 where the comparator 48 scans the cards in the operator hand 38 to determine whether the operator hand 38 has any cards of the same kind (vertical runs) and the number of such cards. The results of this determination are stored. The program then moves to step 196 to determine how many unmatched cards remain in the operator's hand and to count the points of those unmatched cards.

Step 196 is shown in more detail in FIG. 5(*e*). In determining the unmatched points in a hand, the comparator 48 first clears the sum register at step 189 and then at step 191 scans for a card in the hand that is not marked unavailable by having been previously stored as a vertical run. It then moves to step 193 to determine whether the unmatched cards are in a horizontal run and, if they are, stores those cards as unavailable and looks for additional cards which are still unmatched by recirculating to step 191. These additional cards are valued and their point values are added at step 195 in order to obtain a total of unmatched points in the hand. This completes step 196.

The program next proceeds to step 198 to ask whether this is the lowest number of unmatched points in the operator hand 38. Since this cannot be determined on the first circulation until additional computations have been made, the results are stored for later comparison at step 200 and the program proceeds to step 202 to determine whether there are three distinct sets of at least three cards of a kind. If this is found to be true, the program moves to step 204 to determine whether there are any cards which are not in groups of cards of the same kind. If it is found that there are no cards which are not in groups of at least three cards of the same kind, the program moves to step 206 and marks the unmatched points as equal to zero ultimately causing at step 184 the display 18 to output the message "Gin!" If a card is found which is not in a group of three of the same kind at step 204, the program moves to step 208 to determine the total number of unmatched points (which will be in a single card since a hand contains only ten cards and nine must be matched to have moved through step 204). The program then asks at step 210 whether this is the lowest number of unmatched points by comparing with the amounts previously determined and, if so, stores the result at step 212. If there are three vertical runs in the hand, this completes the knock check step 170.

If at step 202 it is determined that there are not three sets of cards of the same kind, the program moves to step 214 to determine whether there are any vertical runs and to step 216 to mark those cards which are in vertical runs of at least three as unavailable for unmatched point checks. The program next moves to step 218 to determine whether there are four cards of like kind in the vertical run. If there are, one of the cards in the vertical run is marked at step 220 as available for an unmatched point check (to allow it to appear in a horizontal run), and the program moves to step 222 to find the unmatched points. If there are not four cards of a kind, the program moves directly to step 222 to find out the unmatched points available (See FIG. 5(*e*)).

This portion of the program is utilized to determine whether a lower unmatched card value is obtained considering all of the cards to be in vertical runs or using some of the cards in horizontal runs. The problem results from the fact that although a particular card might be an intersection of a vertical and horizontal run, it may only be used as a part of one run, not both. Therefore, from step 222, the program moves to step 224 to ask whether this is the lowest number of unmatched points encountered so far. If it is, this value is stored at step 226. If not, the program moves to step 228 to look at the card in the vertical run marked as available for an unmarked point check at step 220. If none, the program moves to step 229 to indicate that this particular group of cards of the same kind has been checked and recirculates to step 214 to determine whether another vertical run (group of cards of the same kind) exists.

If there is a card available at step 228 as an unmarked card, the program moves to step 230 to select the next card in the vertical run as available and to mark the card already checked as unavailable. The program then recirculates through step 222 to determine ultimately which card gives the lowest number of unmatched points at step 224. After checking each of the four cards in a four card vertical run to determine which gives the lowest number of unmatched points (including all four as a vertical run), the vertical run is ultimately marked as checked at step 229; and the program recirculates to step 214. As each group of cards of the same kind are checked, the program recirculates from step 229 to step 214, and a determination will ultimately be made at step 214 that all of the vertical runs have been checked.

In this case, the program moves from step 214 to step 234 to determine whether there are two vertical runs. If two vertical runs do not exist, the lowest number of unmatched points will have already been determined at steps 200 or 226 and the knock check is complete. If there are two vertical runs, the program moves through steps 235 and 236 to mark the cards in the runs as unavailable and find the unmatched points. The program then moves to step 237 to ask whether two vertical runs of four of the same kind exist. If there are not two vertical runs of four of a kind, the program has completed the knock check.

If there are two vertical runs of four of a kind, it may be that a lower unmatched value is formed by counting the extra card in each of the vertical runs as part of the horizontal run. To determine this, the program moves to step 238 to find a card not in the vertical runs. There can only be two such cards since a hand holds but ten cards. Finding such a card, the program asks whether it is in a horizontal run at step 239. If it is not in a horizontal run, the value of that card is added as an unmatched card at step 240 and the second card not in the two groups of four of a kind is selected at step 242. This card is subject to the same test as to whether it falls in a horizontal run at step 244; if not, its value is added to the sum of the unmatched cards values at step 246 and the knock check moves to step 248 to determine whether this is the lowest number of unmatched points. If the card is in a horizontal run, the program proceeds directly to step 248. If, at step 248, this is the lowest number of points, the number is stored at step 250. In either case, the knock check is complete.

If at step 239, it is found that the card is in a horizontal run, the program moves to step 252 to find the second card which is not in one of the two groups of four of a kind. The program then moves to step 254 to ask whether this is in the same horizontal run as the card previously found. It should be noted that any horizontal run must involve at lease one card also in a vertical run. If the second card is not in the same horizontal run, its value is added to the unmatched card value at step 256, and the program proceeds to step 248 to determine whether this is the lowest number of unmatched points. In a case in which both cards are in different horizontal runs, the program will use the smallest of the two cards not in vertical runs in calculating unmatched points. If the card is in the same horizontal run, the program moves to step 258 at which the conclusion is reached that there are no unmatched points and the knock check is complete.

Following completion of the unmatched point calculation, the computer checks the operator's unmatched point total to see if his claim of knock was valid. If so, the program returns to 180. If not, the program proceeds to step 172.

When the draw switch 20 is depressed, the program moves from step 114 shown in FIG. 5(*a*) to junction step 126 (FIG. 5(*f*)). The program then proceeds to step 262 at which a determination of the game state is made. Since the draw switch 20 may only be validly depressed during the middle of the game at the end of the computer's turn when the operator elects to draw a card rather than take the flashing computer discard, any other game state causes the program to recirculate to junction step 110. If the state is the end of the computer's turn during mid game, the program moves to step 264 to switch the game state to the operator's turn, to step 266 to eliminate the flashing discard, and to step 268 to draw one card from the deck 40 for the operator hand 38 and mark that card as flashing. The program then recirculates to junction step 110.

When it has been determined that the discard switch 22 is closed at step 112 of the program as shown in FIG. 5(*a*), the program moves to junction step 124. The program then proceeds, as is shown in FIG. 5(*g*), to step 270 to determine the game state. The discard switch 22 may only be validly closed at the end of the operator's turn so any other indication will cause the program to recirculate to junction step 110. Presuming that it is the operator's turn, the program moves from step 270 to step 272 to switch the state of the game to the computer's turn. The program then moves to step 274 to ask whether the player's discard gives the computer hand 37 knock. This is accomplished in conformance with the flow chart described in FIG. 5(*d*) except that the discard is considered to be one of the cards in the computer hand 36 and each of the other cards is individually considered to be a discard so that the simulator 10 may thereby ascertain whether any combination gives a knock hand. The result of a conclusion that the computer has knock will produce at step 276 a display output of "Thanks." The program will then move to step 278 to calculate the operator's unmatched points and to step 280 to determine whether the operator has undercut the computer by having a smaller number of unmatched points. If the operator has undercut the computer, the program moves to step 282 to award the operator a bonus score of ten points, to step 284 to output the words "knock" on the display 18, and to step 286 to calculate the cumulative score of the operator. If the operator's cumulative score is greater than or equal to one hundred points, this is determined at step 288; and at step 290 the deal switch is disabled, and the program recirculates to junction step 110. If the cumulative score is less than one hundred, the program recirculates to junction step 110 without disabling the deal switch 23.

If at step 280 the operator did not undercut the computer hand 36, then the program moves to step 292 to determine whether the computer has gin in accordance with the knock check as explained in FIG. 5(*d*). If the computer hand 36 has gin, the computer hand 36 is awarded a bonus at step 294 and the display 18 is caused to display the word "Gin!" at step 296. The program then moves to step 286 to calculate cumulative scores as explained above (using the computer's points rather than the operator's points). If the computer does not have gin at step 292, the program moves to step 284 to cause the display 18 to display the word "knock" and then to step 286 to calculate the cumulative score for the computer and then proceeds as explained above.

If at step 274 it is determined that the operator's discard does not give the computer hand 36 knock, the program proceeds to step 300 to determine whether the operator's discard helps the computer hand 36. This is done on the following basis. The computer play control circuit 44 looks at the computer hand 36 including in it the discard and determines whether the discard is part of a horizontal run, part of a vertical run of cards of the same kind. In Gin 2, a card is considered helpful if it gives at least three of a kind, completes a run of three, or provides an intersection between two adjacent cards in a horizontal run and two cards of the same kind. In the lower skilled version of the game (Gin 1), the circuit 44 finds a card is helpful based on the same criteria and in addition if the card makes two of a kind with the other two cards still available (not yet discarded), if it makes two adjacent cards in a horizontal run and the two other cards at both ends of the horizontal run are still available, or if the card forms an intersection between two cards in a horizontal run and two cards of the same kind.

If the operator's discard satisfies none of these conditions, the program moves to step 302 to draw a card from the deck 40 for the computer hand 36. The program next moves to step 304 to cause the display 18 to display the words "No Thanks" and to step 306 to do a check for knock as explained above in FIG. 5(*d*). If the card gives the computer hand 36 knock, the program moves to step 278 and proceeds as explained above to determine who won the hand and calculate points. If the card does not give the computer hand 36 knock, the program proceeds to step 308 to ask whether a value check has been done and then proceeds through a discard selection process. If at step 300 it is found that the operator's discard helps the computer hand 36, the program also moves directly to step 308 and goes through the discard selection process.

If the value check has not been done, the first step in the discard selection process is step 310 which asks whether the game being played is Gin 1 or Gin 2. If Gin 1 is being played the program moves to step 312 to ask how much a first card helps out the computer hand 36 and stores that value. Value, in the preferred embodiment, is determined by assigning points to each card held on the hand on the following basis:

(1) Card is part of vertical run of two with one other card available to complete the vertical run—8 points
(2) Card is part of vertical run of two with two other cards available to complete the vertical run—16 points
(3) Card is part of vertical run of three with no other cards available to increase run length—48 points
(4) Card is part of vertical run of three with one other card available to increase run length—52 points
(5) Card is part of vertical run of four—56 points
(6) Card is part of horizontal run of two separated by one missing card with that missing card available to complete the run—8 points
(7) Card is part of horizontal run of two cards in a row with one adjoining card available to complete the horizontal run—8 points
(8) Card is part of horizontal run of two cards in a row with both adjoining cards available to complete the horizontal run—16 points
(9) Card is part of horizontal run of three or more cards in a row with no adjoining cards available to lengthen the run—48 points
(10) Card is part of horizontal run of three or more cards in a row with one adjoining card available to lengthen the run—52 points
(11) Card is part of a horizontal run of three or more cards in a row with two adjoining cards available to lengthen the run—60 points
(12) Card is an ace or deuce—8 points
(13) Card is a three—3 points The program then circulates from step 312 back to step 308 to select a different card from the computer's hand and proceeds through the same steps 310 and 312 to calculate how valuable each card is.

If the game being played at step 310 is Gin 2, the program first moves to step 314 and, at random, decides whether to look at the operator hand 38. Step 314 is used in order to provide for the ability of accomplished Gin Rummy players to know the cards in an opponent's hand whether by memorizing the discards, by sensing psychological attributes of the opponent, or by other means. Step 314 provides a definite advantage to the computer in addition to that provided by the steps 300.

If at step 314 it is determined that the operator hand 38 should be reviewed, the program moves to step 316 and determines how valuable the particular card is to the operator hand 38 and stores that value (using the same criteria as step 312). The program then circulates to step 312 to determine how much each particular card helps the computer's hand 36 and store that value. This number will be added to the number calculated in box 312 to give the computer an overall idea of how valuable the card is to both the player and computer. If at step 314 it is determined that the operator's hand should not be reviewed, the program moves directly to step 312.

After the program has completed step 312 with all of the cards by recirculating back to step 308 with each such card, the program branches to step 318 to determine whether the card drawn from the deck 40 or taken from the discard was the least valuable card in the hand. This is determined by assessing the values stored at steps 312 and 316. If it was not the least valuable card, the program moves to step 320 and discards the card found to be the least valuable in the computer hand 36. The program then moves to step 322 and if the discard was taken, moves to step 324 to display the word "Thanks" on display 18. If the discard was not taken by the computer hand 36, the program moves to step 326 to cause the display 18 to exhibit an asterisk. In each case, the program then recirculates to junction step 110.

If at step 318 it is determined that the card drawn from the hand 40 or taken from the discard was the least usable in the computer hand 36, the program moves to step 328 to discard that card. If the card discarded was the drawn card, the program moves to step 330 and recirculates to junction step 110. If the card discarded was the previous discard, the program recirculates to step 302 to draw a card and continue through the program as described above.

As will be understood by those skilled in the art, many different programs may be utilized to implement the flow chart disclosed in FIGS. 5(*a*)–5(*g*). Obviously, these programs will vary from one another in some degree. However, it is well within the skill of the art of the computer programmer to provide particular programs for implementing each of the steps of the flow chart disclosed herein. It is also to be understood that various microcomputer circuits other than that selected for the preferred embodiment might be used without departing from the teaching of the invention. It is therefore to be understood that, because various other embodiments may be devised by those skilled in the art without departing from the spirit and scope of the invention, it is the intention of the inventors to be limited only by the scope of the claims appended hereto.

What is claimed is:

1. A portable machine for simulating the play of a hand of gin rummy in accordance with the rules thereof including a housing; a display mounted by the housing; an electronic data processor mounted in the housing; means for causing the processor to deal two hands and a face up card at random and to control the display to show one of the hands and the face up card; means for causing the processor to take the face up card or draw another card at random for the hand shown on the display; means for causing the processor to discard a selected card from the hand shown on the display; means for signalling that the hand shown on the display has gin or knock; means for drawing cards at random or taking a discard from the hand shown on the display for the other of the two hands; means for discarding a selected card from the other of the two hands to enhance the hand value in accordance with the rules of gin rummy; and means for causing the play of the other of the two hands to be at first or second skill levels, including means for discarding cards in the other of the two hands based on the value of the cards to the hand shown on the display.

2. A portable machine as in claim 1 wherein the means for causing the play of the other of the two hands to be at first or second skill levels comprises means for varying the selection criteria for the other of the two hands.

3. In a portable electronic card game simulator including an electronic data processor, means for simulating a deck of cards, means for dealing two gin rummy hands and a face up card from the deck, a display including indicia representing the cards in a single deck of cards, means for using the indicia to display the first one of the hands of cards and face up card, means for allowing an operator to signal whether he desires to draw from the deck or to draw the face up card, means for allowing an operator to signal a discard, means for causing the processor to select cards for the second one of the hands of cards from the simulated deck or the discard, and means for using the indicia to display the second one of the hands of cards, the improvement comprising: means for determining which card have not been discarded, means for determining which of the operator discards is to be selected for the second one of the hands of cards as a function of the cards in the second one of the hands of cards and of the cards which have not been discarded, and means for causing the processor to determine which of the cards should be discarded from the second one of the hands of cards, including means for determining a first value for each of the cards from the second one of the hands of cards, where each first value is based on the worth of the particular card to that same hand where said worth is a function of the cards in the second one of the hands of cards and of the cards which have not been discarded.

4. The portable electronic card game simulator of claim 3 in which the processor further comprises means for discarding from the second one of the hands of cards that card having the lowest first value.

5. In a portable electronic card game simulator including an electronic data processor, means for simulating a deck of cards, means for dealing two gin rummy hands and a face up card from the deck, a display including indicia representing the cards in a single deck of cards, means for using the indicia to display the first one of the hands of cards and face up card, means for allowing an operator to signal whether he desires to draw from the deck or to draw the face up card, means for allowing an operator to signal a discard, means for causing the processor to select cards for the second one of the hands of cards from the simulated deck or the discard, and means for using the indicia to display the second one of the hands of cards, the improvement comprising: means for causing the processor to determine which of the cards should be discarded from the second one of the hands of cards, including means for determining a first value for each of the cards from the second one of the hands of cards, where each first value is based on the worth of the particular card to that same hand, means for determining which of the cards are held in the first one of the hands of cards, and means for determining a second value for each of the cards from the second one of the hands of cards, where each second value is based on the worth of the particular card to the first one of the hands of cards.

6. The portable electronic card game simulator of claim 5 in which the processor further comprises means for discarding from the second one of the hands of cards that card having the lowest sum of the first and the second values.

* * * * *